US011371513B2

(12) United States Patent
Freeman et al.

(10) Patent No.: US 11,371,513 B2
(45) Date of Patent: Jun. 28, 2022

(54) INTEGRATED GAS COMPRESSOR

(71) Applicant: Solar Turbines Incorporated, San Diego, CA (US)

(72) Inventors: Jess Lee Freeman, Poway, CA (US); William Watkins, San Diego, CA (US)

(73) Assignee: Solar Turbined Incorporated, San Diego, CA (US)

( * ) Notice: Subject to any disclaimer, the term of this patent is extended or adjusted under 35 U.S.C. 154(b) by 246 days.

(21) Appl. No.: 16/809,306

(22) Filed: Mar. 4, 2020

(65) Prior Publication Data

US 2021/0277903 A1 Sep. 9, 2021

(51) Int. Cl.

| | |
|---|---|
| ***F04D 17/12*** | (2006.01) |
| ***F04D 29/22*** | (2006.01) |
| ***F04D 17/10*** | (2006.01) |
| ***F04D 25/06*** | (2006.01) |
| ***F04D 29/26*** | (2006.01) |

(Continued)

(52) U.S. Cl.

CPC ..... *F04D 17/122* (2013.01); *F04D 17/10* (2013.01); *F04D 17/12* (2013.01); *F04D 25/06* (2013.01); *F04D 25/0606* (2013.01); *F04D 29/053* (2013.01); *F04D 29/054* (2013.01); *F04D 29/22* (2013.01); *F04D 29/26* (2013.01); *F04D 29/266* (2013.01); *F04D 29/286* (2013.01); *F04D 25/062* (2013.01); *F04D 29/063* (2013.01)

(58) Field of Classification Search

CPC .... F04D 25/0606; F04D 25/06; F04D 29/063; F04D 25/062; F04D 17/12; F04D 17/122; F04D 29/26; F04D 29/266; F04D 29/286; F04D 29/284; F04D 29/053; F04D 29/054; F04D 29/22

See application file for complete search history.

(56) References Cited

U.S. PATENT DOCUMENTS 2,888,193 A * 5/1959 Greenwald ..... F25B 1/053 417/370
2,923,461 A * 2/1960 Dallenbach ..... F04D 29/541 415/209.1

(Continued)

FOREIGN PATENT DOCUMENTS

CN 104235021 12/2014
GB 759033 A 10/1956

(Continued)

OTHER PUBLICATIONS

Written Opinion and International Search Report for International Patent Appln No. PCT/U62021/020608, dated May 14, 2021 (8 pgs).

(Continued)

*Primary Examiner* — Peter J Bertheaud
(74) *Attorney, Agent, or Firm* — Procopio, Cory, Hargreaves & Savitch LLP

(57) ABSTRACT

An integrated gas compressor is disclosed herein. The integrated gas compressor includes an integrated motor with a stator, centrifugal impellers, and a shaft assembly with a rotor and conical transition. The integrated motor can produce an electromotive force that is imparted by the stator to rotate the rotor and components coupled to the rotor, such as the conical transition and the centrifugal impellers. At least one of the rotor and conical transition have a cavity.

9 Claims, 2 Drawing Sheets

(51) Int. Cl.

| | |
|---|---|
| ***F04D 29/28*** | (2006.01) |
| ***F04D 29/053*** | (2006.01) |
| ***F04D 29/054*** | (2006.01) |
| ***F04D 29/063*** | (2006.01) |

(56) References Cited

U.S. PATENT DOCUMENTS

| | | | |
|---|---|---|---|
| 4,404,483 | A | 9/1983 | Lebkuchner |
| 4,808,073 | A | 2/1989 | Zaehring et al. |
| 7,942,635 | B1 | 5/2011 | Murray |
| 8,113,772 | B2 | 2/2012 | Baumhauer et al. |
| 10,392,939 | B2 | 8/2019 | McKay et al. |
| 2009/0031732 | A1 | 2/2009 | Wilson, Jr. |
| 2009/0232689 | A1 | 9/2009 | Prior |
| 2015/0104335 | A1 | 4/2015 | Faller |

FOREIGN PATENT DOCUMENTS

| | | |
|---|---|---|
| WO | 2012034480 | 3/2012 |
| WO | 2017148891 A1 | 9/2017 |

OTHER PUBLICATIONS

Buse, et al., "Adapting Hermetically Sealed Compressor Technology to Deal With Sour and Corrosive Gases," gascompressionmagazine.com, Apr. 2018, 10 pages.

Canned, Clean and Smart, Siemens AG, 2008, www.siemens.com/oil-gas, 4 pages.

Kapp, Chris, "STC-ECO Canned, Clean and Smart," Gas Electric Partnership, Feb. 2009, Houston Texas, 5 pages.

* cited by examiner

INTEGRATED GAS COMPRESSOR

TECHNICAL FIELD

The present disclosure generally pertains to a support assembly for a rotary machine, and is more particularly directed toward integrated gas compressors with a hollow rotating component.

BACKGROUND

Centrifugal gas compressors can include a variety of rotating components that can be operated at high rotational speeds. These rotational speeds may be capped to prevent resonant frequencies from being reached. However limiting rotational speed can limit the total output of the compressor.

U.S. Pat. No. 7,942,635 to Murray discloses a small twin spool gas turbine engine with a hollow inner rotor shaft having solid shaft ends. The small twin spool gas turbine engine includes an outer rotor shaft having a cylindrical portion on the compressor end that forms a forward bearing support surface and a turbine rotor disk on the turbine end that forms an aft bearing support surface. The inner rotor shaft includes solid shaft ends that project out from the cylindrical portion of the outer shaft on one end and out from the turbine rotor disk on the other end. An inner bearing housing is secured on the solid shaft ends of the inner rotor shaft. A threaded nut on the inner rotor shafts ends provide a compressive load to the inner bearing housings which results in a tension preload to the inner rotor shaft solid ends so that the bearing assemblies for the forward and aft ends of the twin spools do not become lose from the engine operation.

The present disclosure is directed toward improvements in the art.

SUMMARY

An integrated gas compressor is disclosed herein. The integrated gas compressor including a housing, a plurality of centrifugal impellers positioned within the housing, and an integrated motor positioned within the housing. The integrated motor including a cylindrical stator, and a cylindrical rotor positioned inward and adjacent to the cylindrical stator. The integrated gas compressor further including a conical transition extending from the rotor to the plurality of centrifugal impellers. At least one of the conical transition and cylindrical rotor having a cavity.

BRIEF DESCRIPTION OF THE FIGURES

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent to those skilled in the art that embodiments of the invention can be practiced without these specific details. In some instances, well-known structures and components are shown in simplified form for brevity of description.

Figure 1:
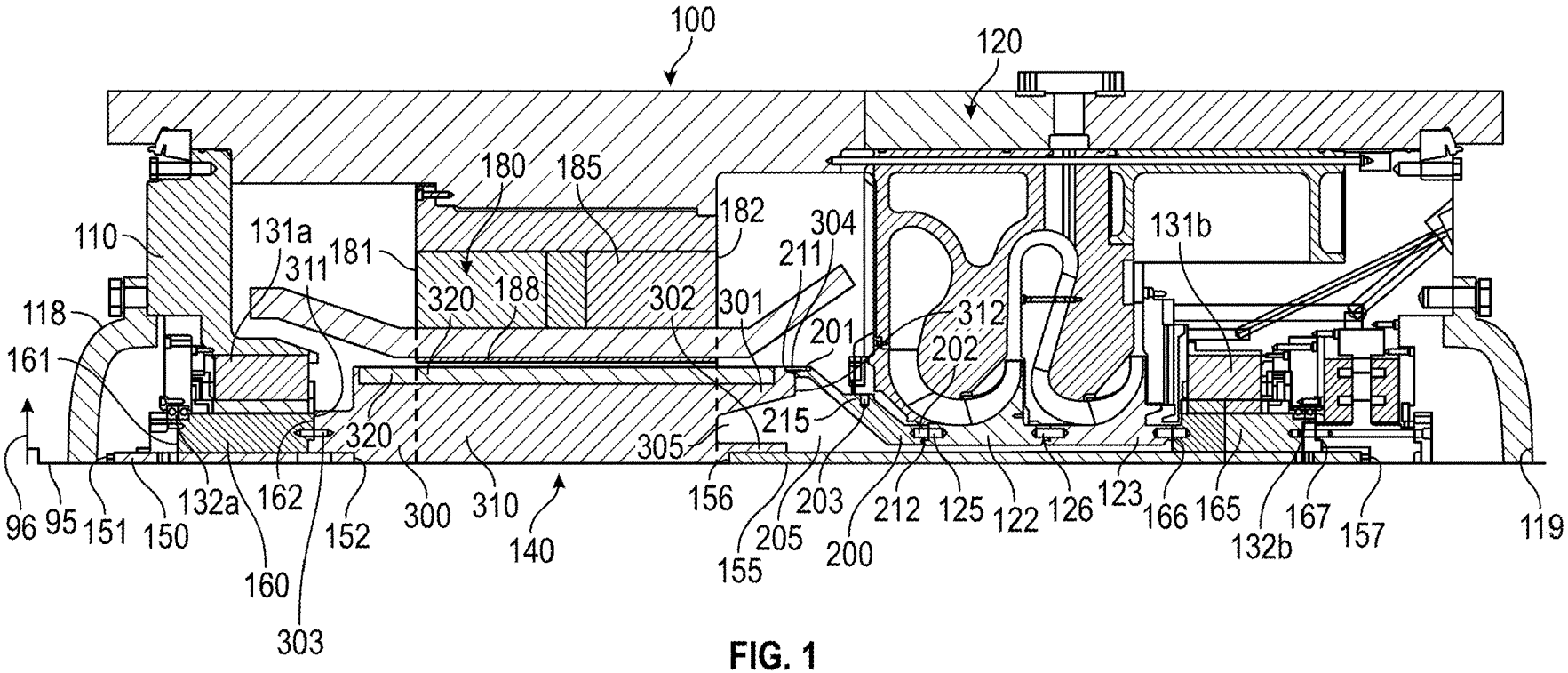
FIG. 1 is a cross-section illustration of an upper half an integrated gas compressor.

FIG. 1 is a cross-section illustration of an upper half an integrated gas compressor 100 (sometimes referred to as a gas compressor). In some embodiments the integrated gas compressor 100 can be symmetrical about an axis of rotation 95. Some of the surfaces have been left out or exaggerated (here and in other figures) for clarity and ease of explanation. The disclosure may generally reference an axis of rotation 95 of the gas compressor 100, which may be generally defined by the longitudinal axis of its shaft assembly 140. The axis of rotation 95 may be common to or shared with various other concentric components of the gas compressor 100. All references to radial, axial, and circumferential directions and measures refer to axis of rotation 95, unless specified otherwise, and terms such as "inner" and "outer" generally indicate a lesser or greater radial distance from the axis of rotation 95, wherein a radial 96 may be in any direction perpendicular and radiating outward from axis of rotation 95.

The gas compressor 100 includes a housing 110, a shaft assembly 140, an integrated motor 180, magnetic bearing assemblies 131*a, b*, auxiliary bearing assemblies 132*a, b*, and a centrifugal compressor 120. The housing can have a front end 118 and a back end 119 opposite the front end 118. The shaft assembly 140, integrated motor 180, magnetic bearing assemblies 131*a, b*, auxiliary bearing assemblies 132*a, b*, and centrifugal compressor 120 can all be positioned within the housing 110. In other words, without the shaft assembly 140 or other components protruding through the housing 110.

The shaft assembly 140 can include a first tie bolt 150, a second tie bolt 155, a first shaft 160, a second shaft 165, a rotor 300, and a conical transition 200. The centrifugal compressor 120 can include first centrifugal impellers 122 and second centrifugal impellers 123, sometimes collectively referred to as centrifugal impellers.

Process gas enters the centrifugal gas compressor 100 at the suction port formed on the housing 110. The process gas is compressed by one or more centrifugal impellers 122, 123 rotating about the shaft assembly 140. The compressed process gas exits the centrifugal gas compressor 100 at a discharge port that is formed on the housing 110.

The shaft assembly 140 and attached elements may be supported by the magnetic bearing assemblies 131*a, b* and auxiliary bearing assemblies 132*a, b*.

The first tie bolt 150 can have a first tie bolt front end 151 and first tie bolt back end 152 opposite the first tie bolt front end 151. The first tie bolt 150 can extend from proximate the front end 118 to adjacent the rotor 300.

The second tie bolt 155 can have a second tie bolt front end 156 and second tie bolt back end 157 opposite the second tie bolt front end 156. The second tie bolt 155 can extend from adjacent the rotor 300 to proximate the back end 119.

The first tie bolt 150 and second tie bolt 155 can axially restrain and fasten the components of the shaft assembly 140, first centrifugal impellers 122, and second centrifugal impellers 123 together. Dowels can be installed within dowels slots of the shaft assembly 140, first centrifugal impellers 122, and second centrifugal impellers 123 to transmit torque between the components and can provide additional restraint.

The first shaft 160 can be hollow and positioned proximate to the front end 118. The first shaft 160 can be concentric with the first tie bolt 150. In an embodiment the first shaft 160 can be coupled to the first tie bolt 150. The first shaft 160 can extend from proximate the front end 118 to adjacent the rotor 300. The first shaft 160 can have a first shaft front end 161 and a first shaft back end 162 opposite from the first shaft front end 161.

The second shaft 165 can be hollow and positioned proximate to the back end 119. The second shaft 165 can be concentric with the second tie bolt 155. In an embodiment the second shaft 165 can be coupled to the second tie bolt 155. The second shaft 165 can extend from proximate the back end 119 to adjacent the second centrifugal impellers 123. The second shaft 165 can have a second shaft front end 166 and a second shaft back end 167 opposite from the second shaft front end 166.

The first auxiliary bearing assembly 132*a* can be positioned concentric with the first shaft 160. The first auxiliary bearing assembly 132*a* can be coupled with the first shaft 160. The first auxiliary bearing assembly 132*a* can be positioned proximate to the first shaft front end 161.

The first magnetic bearing assembly 131*a* can be positioned concentric with the first shaft 160. The first magnetic bearing assembly 131*a* can be coupled with the first shaft 160. The first magnetic bearing assembly 131*a* can extend from proximate the first shaft back end 162 towards the first shaft front end 161.

The second auxiliary bearing assembly 132*b* can be positioned concentric with the second shaft 165. The second auxiliary bearing assembly 132*b* can be coupled with the second shaft 165. The second auxiliary bearing assembly 132*b* can be positioned proximate to the second shaft back end 167.

The second magnetic bearing assembly 131*b* can be positioned concentric with the second shaft 165. The second magnetic bearing assembly 131*b* can be coupled with the second shaft 165. The second magnetic bearing assembly 131*b* can extend from proximate the second shaft front end 166 towards the second shaft back end 167.

The first centrifugal impellers 122 can be concentric with the second tie bolt 155. The first centrifugal impellers 122 can be axially positioned between the rotor 300 and the second centrifugal impellers 123 with respect to the axis of rotation 95. The first centrifugal impellers 122 can be axially positioned between the integrated motor 180 and the back end 119. The first centrifugal impellers 122 can have front impeller dowel slots 125 and back impeller dowel slots 126 axially opposite the front impeller dowel slots 125. The first centrifugal impellers 122 can be coupled to the second centrifugal impellers 123 at least partially at the back impeller dowel slots 126.

The second centrifugal impellers 123 can be concentric with the second tie bolt 155. The second centrifugal impellers 123 can be axially positioned between the second shaft 165 and the first centrifugal impellers 122 with respect to the axis of rotation 95. The second centrifugal impellers 123 can be axially positioned between the back end 119 and the rotor 300 with respect to the axis of rotation 95. The second centrifugal impellers 123 can be coupled to the second shaft 165 proximate to the second shaft front end 166.

The integrated motor 180 can be coupled to the housing 110. The integrated motor 180 can be located radially outward of the rotor 300. In an embodiment the integrated motor 180 includes the rotor 300. The integrated motor 180 can include a stator 188. The stator 188 can be a hollow cylinder (sometimes referred to as a cylindrical stator) that extends axially along the axis of rotation 95. The stator 188 can be located radially outward of and adjacent to the rotor 300. The integrated motor 180 can produce an electromotive force that is imparted by the stator 188 to rotate the rotor 300. In an example the stator 188 can include stator coils and the rotor 300 can include magnets. The integrated motor 180 can produce an active magnetic area 185 that extends from the integrated motor 180 and through the rotor 300. The active magnetic area 185 can extend the axial length of the stator 188 and be represented by a magnetic area front end 181 and a magnetic area back end 182 axially opposite from the magnetic area front end 181 with respect to the axis of rotation 95. The integrated motor 180 can be axially positioned between the front end 118 and the first centrifugal impellers 122.

The conical transition 200 can have a hollow and generally conical shape, similar to a frustoconical, toriconical cone, and/or conical reducer. The conical transition 200 can be positioned axially between the first shaft 160 and the second shaft 165 with respect to the axis of rotation 95. In an embodiment, the conical transition 200 can be positioned axially between the rotor 300 and the first centrifugal impellers 122. The conical transition 200 can be positioned axially between the second tie bolt front end 156 and the second tie bolt back end 157.

The conical transition 200 can have a conical transition front end 211, a conical transition back end 212 axially opposite the conical transition front end 211, and a middle step 215 located between the conical transition front end 211 and the conical transition back end 212. The middle step 215 can have an annular shape (sometimes referred to as annular middle step) and can extend around the axis of rotation 95. The conical transition front end 211 can be positioned adjacent to the rotor back end 312. The conical transition back end 212 can be positioned adjacent to the first centrifugal impellers 122.

The conical transition 200 can include front transition dowel slots 201 positioned adjacent to the conical transition front end 211. The conical transition 200 can include back transition dowel slots 202 axially opposite of the front transition dowel slots 201 and positioned adjacent to the conical transition back end 212. In an embodiment, the front transition dowel slots 201 and back transition dowel slots 202 are oriented longitudinal to the axis of rotation 95. The plurality of front transition dowel slots 201 and plurality of back transition dowel slots 202 can be spaced circumferentially around the conical transition 200. The plurality of front transition dowel slots 201 can align with a plurality of back rotor dowel slots 304 of the rotor 300. The plurality of back transition dowel slots 202 can be aligned with the front impeller dowel slots 125.

The middle step 215 can include middle transition dowel slots 203. In an embodiment, middle transition dowel slot 203 are oriented radial to the axis of rotation 95. The plurality of middle transition dowel slots 203 can be spaced circumferentially around the middle step 215.

The conical transition 200 can couple with the rotor 300 at the conical transition front end 211 and the rotor back end 312 via the front transition dowel slots 201 and back rotor dowel slots 304. The conical transition 200 can couple with the first centrifugal impellers 122 at the conical transition back end 212 and the back transition dowel slots 202 and the front impeller dowel slots 125. The conical transition 200 can couple with the first centrifugal impellers 122 at the middle step 215 and the middle transition dowel slots 203.

The conical transition 200 can define a conical transition cavity 205. The conical transition cavity 205 can be a conical shaped void. The conical transition cavity 205 can extend from the conical transition front end 211 to the conical transition back end 212.

In an embodiment the conical transition cavity 205 can be adjacent to and be in fluid communication with the rotor cavity 305. The conical transition cavity 205 can be radially larger adjacent to the rotor 300 than away from the rotor 300. In other words, the conical transition 200 can be radially larger at the conical transition front end 211 than at the conical transition back end 212.

The conical transition 200 can be concentric with the second tie bolt 155. The conical transition 200 can be spaced radially outward from the second tie bolt 155, forming a space between the conical transition 200 and the second tie bolt 155. The conical transition 200 can be located radially inward of the integrated motor 180.

The rotor 300 can be cylindrically shaped (sometimes referred to as a cylindrical rotor) and centered about the axis of rotation 95. The rotor 300 can be positioned radially inward of the integrated motor 180. The rotor 300 can have a rotor front end 311 and a rotor back end 312 opposite from the rotor front end 311. The rotor 300 can include front rotor dowel slots 303 positioned adjacent to the rotor front end 311. The rotor 300 can include back rotor dowel slots 304 axially opposite of the front rotor dowel slots 303 and positioned adjacent to the rotor back end 312. In an embodiment, the front rotor dowel slots 303 and back rotor dowel slots 304 are oriented longitudinal to the axis of rotation 95. The plurality of front rotor dowel slots 303 and plurality of back rotor dowel slots 304 can be spaced circumferentially around the rotor 300.

The rotor 300 can have a rotor body 310 and a rotor laminate 320. The rotor laminate 320 can be located radially outward of the majority of the rotor body 310. The rotor laminate 320 can be located adjacent to the stator 188. The rotor laminate 320 can be attached to the rotor body 310 by interference fit. The rotor laminate 320 can include ferromagnetic materials.

The rotor 300 can have a rotor first protrusion 301 and a rotor second protrusion 302 located proximate to the rotor back end 312. The rotor first protrusion 301 can extend from the rotor back end 312 and taper wider the closer the rotor first protrusion 301 extends to the rotor body 310. In an embodiment the rotor first protrusion 301 can be coupled with the conical transition front end 211. In an embodiment, the rotor first protrusion 301 extends from adjacent the conical transition front end 211 to adjacent the magnetic area back end 182, but does not cross the magnetic area back end 182.

The rotor second protrusion 302 can be radially spaced from and radially inward of the rotor first protrusion 301. The rotor second protrusion 302 can extend from the rotor body 310 axially towards the rotor back end 312. In an embodiment the rotor second protrusion 302 can be coupled with the second tie bolt 155 proximate the second tie bolt front end 156. In an embodiment, the rotor second protrusion 302 extends from adjacent the magnetic area back end 182 towards the back end 119, but does not cross the magnetic area back end 182.

The rotor can include a rotor cavity 305 located adjacent to the rotor back end 312. The rotor cavity 305 can be defined by the rotor first protrusion 301, the rotor body 310, and the rotor second protrusion 302. The rotor cavity 305 can have a frustoconical shape. The rotor cavity 305 can be adjacent to the conical transition 200. The rotor cavity 305 can be radially larger adjacent to the conical transition 200 than away from the conical transition 200. In other words, the rotor cavity 305 can be radially larger proximate the rotor back end 312 than away from the rotor back end 312. In an embodiment the conical transition cavity 205 can be radially larger than the rotor cavity 305 at the interface between the rotor 300 and the conical transition 200. In an embodiment the rotor cavity 305 remains outside of the axial extension of the stator 188 and does not extend to within the stator 188.

The rotor 300 can extend from the first tie bolt 150 to the second tie bolt 155. In an example the rotor 300 can be coupled to the first tie bolt 150, proximate to the first tie bolt back end 152 and the rotor front end 311. In an example the rotor 300 can be coupled to the second tie bolt 155, proximate to the second tie bolt front end 156. The rotor 300 can extend from adjacent the first shaft 160 to adjacent the second shaft 165.

Figure 2:
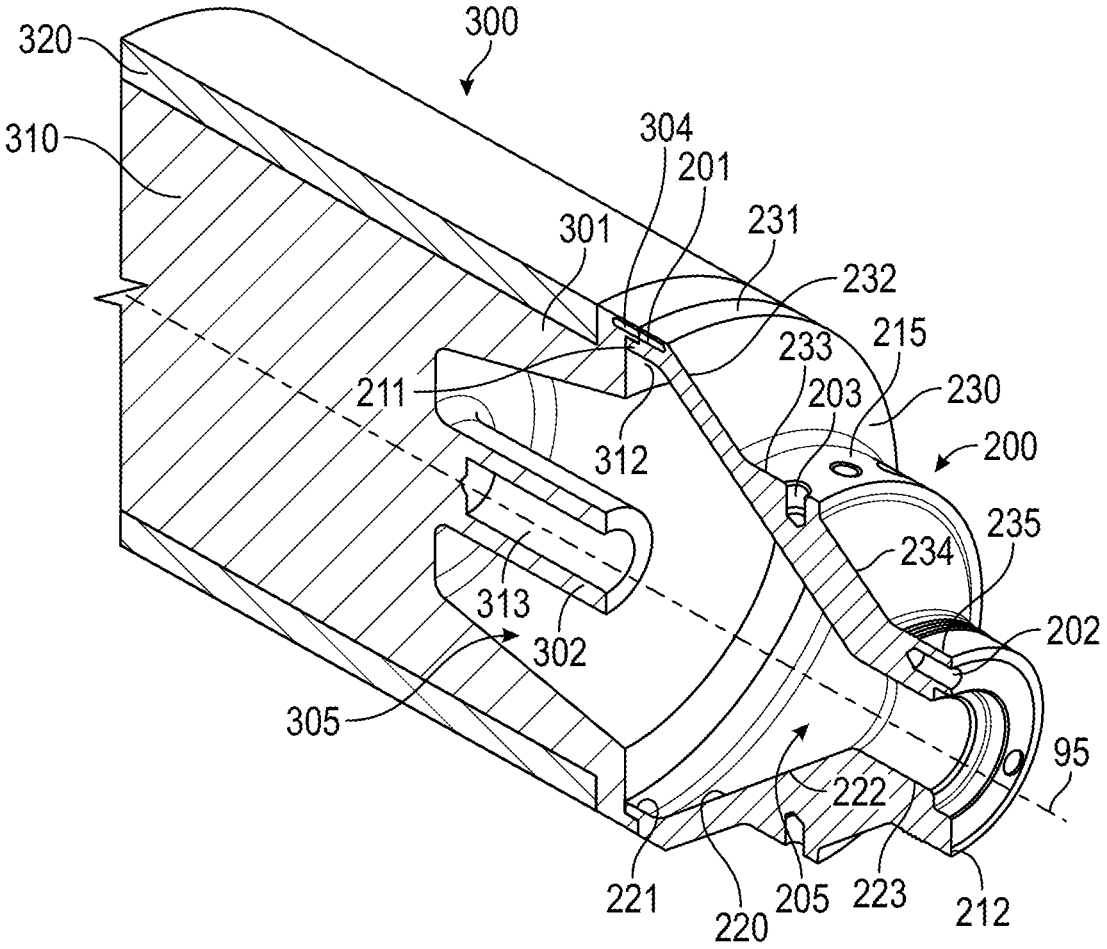
FIG. 2 is an enlarged perspective view of the conical transition and a portion of the rotor from FIG. 1.

FIG. 2 is an enlarged perspective view of the conical transition and a portion of the rotor from FIG. 1. The rotor 300 can have a rotor tie rod opening 313 proximate to the rotor back end 312. The rotor tie rod opening 313 can be defined by the rotor second protrusion 302 and the rotor body 310. The rotor tie rod opening 313 can receive the second tie bolt front end 156 (shown in FIG. 1).

The rotor first protrusion 301 can be shaped with a lip that can align and receive a lip of the conical transition 200 at the conical transition front end 211 and rotor back end 312.

The conical transition can have an inner surface 220 and an outer surface 230 radially opposite the inner surface 220. In an embodiment, the inner surface 220 can include a first inner annular surface 221 adjacent to the conical transition front end 211, a second inner annular surface 223 adjacent to the conical transition back end 212, and an inner conical surface 222 extending from adjacent the first inner annular surface 221 to adjacent the second inner annular surface 223. In an embodiment the second inner annular surface 223 is radially smaller than the first inner annular surface 221.

In an embodiment, the outer surface 230 can include a first outer annular surface 231 adjacent to the conical transition front end 211, a second outer annular surface 233 at the middle step 215, and a third outer annular surface 235 adjacent to the conical transition back end 212. The outer surface 230 can include a first outer conical surface 232 extending from adjacent the first outer annular surface 231 to adjacent the second outer annular surface 233. The outer surface 230 can include a second pouter conical surface 234 extending from adjacent the second outer annular surface 233 to adjacent the third outer annular surface 235.

In an embodiment the second outer annular surface 233 is radially smaller than the first outer annular surface 231. In an embodiment the third outer annular surface 235 is radially smaller than the second outer annular surface 233.

INDUSTRIAL APPLICABILITY

Integrated centrifugal gas compressors 100 are used to move process gas from one location to another. Centrifugal gas compressors 100 can include an integral motor, sometimes referred to as integrated gas compressors. Centrifugal gas compressors 100 are often used in the oil and gas industries to move natural gas in a processing plant or in a pipeline. Centrifugal gas compressors 100 are driven by gas turbine engines, electric motors, or any other power source.

There is a desire to achieve greater efficiencies and reduce emissions in large industrial machines such as centrifugal gas compressors. The rotation speed of the shaft assembly 140 within integrated gas compressors can be limited by the natural frequency of the rotating components such as the shaft assembly 140. Reducing the rotating weight of the shaft assembly 140 can mitigate vibrations during operation of the centrifugal gas compressor 100. Higher operation vibration frequency can give operating room for higher rotational speeds of the shaft assembly 140 and attached components. The reduction of weight can have the most impact on the vibration frequency of the shaft assembly 140 around the middle of the integrated gas compressor 100.

The conical transition 200 can be designed with less material and therefor weight located near the axis of rotation 95 while maintaining a majority of its structural integrity. In an embodiment, the conical transition 200 has a conical transition cavity 205 that leads to a lighter part weight and has a similar stiffness in comparison to a conical transition that is built solid.

The rotor 300 can be designed with less material and therefor weight located near the axis of rotation 95 while maintaining a majority of its structural integrity. In an embodiment, the rotor 300 has a rotor cavity 305 that leads to a lighter part weight and has a similar stiffness in comparison to a rotor 300 that is built solid. The axial length of the rotor cavity 305 may be limited by the active magnetic area 185. If the rotor cavity 305 extends into the active magnetic area 185, for example crosses the magnetic area back end 182, there can be a negative impact on the performance of the integrated gas compressor 100.

In an embodiment at least of the conical transition 200 and rotor 300 have a cavity 205, 305. In an embodiment both the conical transition 200 and the rotor 300 can have cavities 205, 305 to reduce weight. The cavities 205, 305 can be conically shaped. In other examples the rotor can have a ribbed portion or other geometry that includes cavities and spaces between material of the rotor 300. In an example the conical transition 200 can have a conical transition cavity 205 while the rotor 300 is solid. In an example the rotor 300 can have a rotor cavity 305 while the conical transition 200 is solid.

It will be understood that the benefits and advantages described above may relate to one embodiment or may relate to several embodiments. Aspects described in connection with one embodiment are intended to be able to be used with the other embodiments. Any explanation in connection with one embodiment applies to similar features of the other embodiments, and elements of multiple embodiments can be combined to form other embodiments. The embodiments are not limited to those that solve any or all of the stated problems or those that have any or all of the stated benefits and advantages.

The preceding detailed description is merely exemplary in nature and is not intended to limit the invention or the application and uses of the invention. The described embodiments are not limited to use in conjunction with a particular type of gas compressor. Hence, although the present embodiments are, for convenience of explanation, depicted and described as being implemented in a centrifugal gas compressor, it will be appreciated that it can be implemented in various other types of compressors and machines with rotating components, and in various other systems and environments. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

What is claimed is:

1. An integrated gas compressor, the integrated gas compressor comprising:

a housing;

a plurality of centrifugal impellers positioned within the housing;

an integrated motor positioned within the housing having a cylindrical stator, and a cylindrical rotor positioned inward and adjacent to the cylindrical stator; and a conical transition extending from the cylindrical rotor to the plurality of centrifugal impellers;

wherein the rotor includes a rotor cavity adjacent the conical transition and the rotor cavity does not extend to within the cylindrical stator, and wherein the conical transition includes a conical transition cavity adjacent to the cylindrical rotor.

2. The integrated gas compressor of claim 1, wherein the cavity is conically shaped.

3. The integrated gas compressor of claim 1, wherein the rotor cavity is radially larger adjacent to the conical transition than away from the conical transition.

4. The integrated gas compressor of claim 1, wherein the conical transition cavity is radially larger adjacent to the cylindrical rotor than away from the cylindrical rotor.

5. The integrated gas compressor of claim 1, wherein the conical transition cavity is radially larger than the rotor cavity at an interface between the cylindrical rotor and the conical transition.

6. An integrated gas compressor comprising:

a conical transition having a conical transition front end, a conical transition back end located opposite of the conical transition front end, the conical transition back end radially smaller than the conical transition front end, an annular middle step located between the conical transition front end and the conical transition back end, and a conical transition cavity extending from the conical transition front end to the conical transition back end, the conical transition cavity having a toriconical shape;

a housing, and an integrated motor positioned within the housing, the integrated motor including a stator and a rotor inward of the stator, the rotor having back rotor dowel slots, and wherein the conical transition front end includes a plurality of front transition dowel slots positioned and shaped to align with the back rotor dowel slots.

7. The integrated gas compressor of claim 6, further including a plurality of centrifugal impellers positioned within the housing, the plurality of centrifugal impellers having front impeller dowel slots, and wherein the conical transition back end includes a plurality of back transition dowel slots positioned and shaped to align with the front impeller dowel slots.

8. The conical transition of claim 7, wherein the annular middle step includes middle transition dowel slots for coupling with the plurality of centrifugal impellers.

9. An integrated gas compressor comprising:

a rotor comprising a rotor front end, a rotor back end located opposite the rotor front end, and a rotor cavity located adjacent to the rotor back end and having a conical shape, the rotor cavity radially larger proximate the rotor back end than away from the rotor back end;

a housing;

a plurality of centrifugal impellers positioned within the housing;

a conical transition coupled to the plurality of centrifugal impellers, the conical transition having front transition dowel slots; and wherein the rotor back end includes a plurality of back rotor dowel slots positioned and shaped to align with the front transition dowel slots.

* * * * *